US006062436A

United States Patent [19]

Fuchs

[11] Patent Number: 6,062,436

[45] Date of Patent: May 16, 2000

[54] FLEXIBLE VENTED SELF-SEALING DISPENSING VALVE

[75] Inventor: Timothy J. Fuchs, Perrysburg, Ohio

[73] Assignee: Owens-Illinois Closure Inc., Toledo, Ohio

[21] Appl. No.: 09/053,709

[22] Filed: Apr. 2, 1998

[51] Int. Cl.[7] ..... B65D 35/50

[52] U.S. Cl. ..... 222/212; 222/482; 222/494; 137/846

[58] Field of Search ..... 222/212, 482, 222/490, 494; 137/844, 845, 846

[56] References Cited

U.S. PATENT DOCUMENTS

| | | | |
|---|---|---|---|
| 1,206,661 | 11/1916 | Booth . | |
| 2,175,052 | 10/1939 | Bull et al. . | |
| 2,292,373 | 8/1942 | Groeniger . | |
| 2,644,663 | 7/1953 | Klinger . | |
| 2,667,992 | 2/1954 | Hammond et al. | 222/490 X |
| 3,773,233 | 11/1973 | Souza | 222/490 |
| 3,822,720 | 7/1974 | Souza . | |
| 3,941,149 | 3/1976 | Mittleman | 137/848 X |
| 4,143,853 | 3/1979 | Abramson . | |
| 4,341,239 | 7/1982 | Atkinson . | |
| 4,646,945 | 3/1987 | Steiner et al. | 222/212 X |
| 5,005,737 | 4/1991 | Rohr | 222/212 |
| 5,115,950 | 5/1992 | Rohr | 222/212 X |
| 5,301,707 | 4/1994 | Hofsteenge | 137/846 X |
| 5,339,995 | 8/1994 | Brown et al. | 222/212 |
| 5,390,805 | 2/1995 | Bilani et al. | 222/490 X |
| 5,439,143 | 8/1995 | Brown et al. | 222/212 X |
| 5,472,122 | 12/1995 | Appleby | 222/212 |
| 5,655,687 | 8/1997 | Fitten et al. | 222/212 |
| 5,842,618 | 12/1998 | Julemont et al. | 222/490 |

FOREIGN PATENT DOCUMENTS

| | | |
|---|---|---|
| 0495440 | 7/1992 | European Pat. Off. . |
| 19612561 | of 1997 | Germany . |
| 19640629 | of 1998 | Germany . |
| 9910247 | 3/1999 | WIPO . |

*Primary Examiner*—Kenneth Bomberg

[57] ABSTRACT

A squeeze-type container package that comprises a flexible resilient container body and a self-sealing closure assembly mounted to the mouth of the container body. The self-sealing closure assembly includes a dispensing valve of one-piece integrally molded elastic construction having an annular base, an internal wall portion that extends radially inwardly and axially from the base, and a mouth portion that includes a slit opening oriented diametrically of the annular base. Internal stresses within the wall portion bias the slit to the closed position. An annular lip that extends radially outwardly from the valve cooperates with an annular internal rib on the closure for venting the interior of the container body to atmosphere when the container body is released following dispensing of product.

46 Claims, 3 Drawing Sheets

FLEXIBLE VENTED SELF-SEALING DISPENSING VALVE

The present invention is directed to a self-sealing closure assembly for a resilient squeeze-type container package, and more particularly to self-sealing valve and method of construction for such an assembly.

BACKGROUND AND SUMMARY OF THE INVENTION

It has heretofore been proposed to provide a squeeze-type container package for dispensing viscous products, such as toothpaste, that includes a resilient self-closing valve mounted on a closure assembly at the container mouth. The valve is of resilient elastomeric composition, and includes a dispensing opening that is normally closed by internal resiliency of the valve material. When the flexible container is squeezed to dispense product, internal pressure forces the product through the valve opening. When the container is released, negative pressure within the container retracts the product at the container opening, so that the valve opening is closed both by the negative pressure of retracting product and internal resiliency of the valve material. In valves of this type of conventional design, it is typically necessary to cut the dispensing opening in the valve in a secondary operation after molding of the valve body.

It is a general object of the present invention to provide a self-closing valve of the described character, and a method of fabrication, in which the dispensing opening is fabricated in the valve during molding of the valve body in a unitary integrally molded construction, and thus does not require a secondary operation to form the dispensing opening. Another object of the present invention is to provide a valve and method of construction of the described character in which the valve cooperates with the closure when assembled to a squeeze-type dispensing package automatically to vent air into the package when the container body is released following a dispensing operation. Yet another of the present invention is to provide a self-closing valve, a method of fabrication, a valve and closure assembly, and a squeeze-type container package that achieve one or more of the foregoing objectives, and may be readily and inexpensively fabricated employing otherwise conventional technology.

A valve for a self-sealing dispensing closure in accordance with one aspect of the present invention takes the form of a one-piece construction of integrally molded elastic composition that has an annular base, an internal wall portion that extends radially and axially from the annular base, and a mouth portion that includes a slit oriented diametrically of the annular base. The wall portion of the valve is internally stressed for resiliently biasing the slit closed. A pair of lugs are provided on the wall portion of the valve diametrically opposed to each other and orthogonal to the slit opening on a side of the wall portion remote from the annular base, with the lugs being internally stressed for assisting the wall portion in resiliently biasing the slit opening to a closed position. Ribs on the mouth portion of the valve extend along each side of the slit opening, and are internally stressed for maintaining diametric orientation of the slit opening.

The valve is mounted in accordance with another aspect of the invention in a self-sealing closure assembly that includes a plastic closure shell having a central opening at which the slit opening of the valve is disposed. In accordance with a third aspect of the invention, the closure assembly is mounted on a resilient container body. The valve has a peripheral rib that extends radially outwardly from the annular base, which is captured by a basket within the closure against the base wall of the closure. A peripheral lip extends radially outwardly from the rib, and normally engages an annular internal rib on the base wall of the closure. When the resilient container is released following dispensing of product, negative pressure within the container pulls the lip from the annular rib on the closure, and the internal volume of the container is vented to atmosphere around the lip through a series of channels between the valve rib and the closure base, and through an opening in the basket that captures the valve against the closure base.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
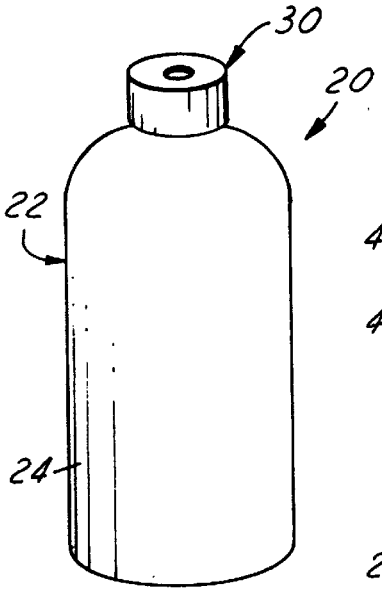
FIG. 1 is a perspective view of a closure and container package in accordance with a presently preferred embodiment of the invention.

FIG. 1 illustrates a squeeze-type container package 20 in accordance with one aspect of the present invention as comprising a container 22 of flexible resilient composition such as blow-molded plastic. Container 22 has a body 24 and an open mouth 26 surrounded by an externally threaded cylindrical finish 28. A closure assembly 30 is mounted to finish 28. Closure assembly 30 (FIGS. 1, 2, 4 and 5) includes a closure or overcap 32, a basket 34 mounted within closure 32, and a self-closing valve 36 captured by basket 34 within closure 32. Container 22 may be fabricated of any suitable material by any suitable technique, such as polypropylene or an extrusion/blow-molding operation.

Referring to FIGS. 4–7, closure 32 has a flat base wall 38 and a circumferentially continuous peripheral skirt 40. Skirt 40 includes suitable means for affixing closure 32 and closure assembly 30 to finish 28 of container 22, such as internal threads 42 (FIG. 2) for coupling with external threads 44 on the container finish. A central opening 46 in closure base wall 38 provides for dispensing of product from within the container package. A shoulder 47 extends around the inside of closure 32 at the juncture of skirt 40 and the undersurface of base wall 38. Shoulder 47 has a radially inwardly extending lip 48 at controlled axial spacing from base wall 38, for purposes to be described. Closure 32 may be formed of any suitable material employing any suitable manufacturing technique, such as polypropylene fabricated in an injection molding operation.

Figure 8:
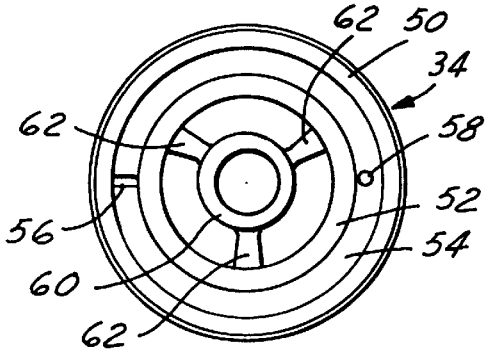
FIGS. 8 and 9 are top plan and side elevational views of the basket illustrated in FIG. 5.
Figure 9:
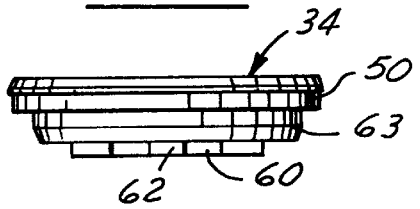

Basket 34 (FIGS. 5, 8 and 9) includes a cylindrical peripheral wall 50 from which a flat base 52 extends radially inwardly. A channel 54 is formed around the major portion of base 52 adjacent to wall 50, being interrupted by a radial rib 56. A through-opening 58 extends through base 52 within channel 54 at a position diametrically opposite rib 56. A cylindrical collar 60 is carried within base 52 by three angularly spaced radial spokes 62. The interior of collar 60 and the area exterior to collar 60 between spokes 62 are open for passage of product from within the container package. A skirt 63 depends from base 52 beneath channel 54 adjacent to wall 50. Peripheral wall 50 has an outwardly projecting ledge 61, from which wall 50 slopes radially inwardly to the axial end of basket 34. Basket 34 may be formed by suitable techniques and of suitable composition, such as polypropylene formed in an injection molding operation.

Figure 10:
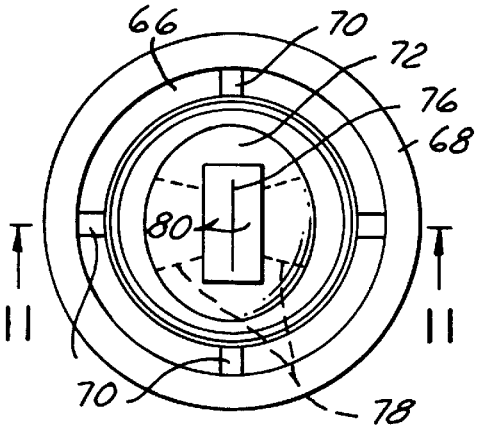
FIG. 10 is a top plan view of the self-closing valve in the assembly of FIGS. 4 and 5.
Figure 11:
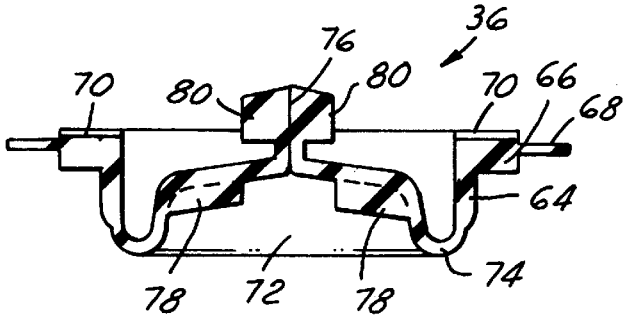
FIG. 11 is a sectional view taken substantially along the line 11—11 of FIG. 10.

Self-closing valve 36 is illustrated in greater detail in FIGS. 10 and 11. Valve 36 includes an annular circumferentially continuous base 64 that terminates at its upper end (in the orientation of FIGS. 2–3 and 10) in a radially outwardly extending circumferentially continuous rib 66. A circumferentially continuous lip 68 extends radially outwardly from rib 66, being positioned beneath the upper surface of rib 66 and of thinner and more resilient construction than the rib. Four radially oriented slots 70 extend along the upper surface of rib 66 at 90 degree spacing from each other. At the lower end of annular base 64, a wall portion 72 extends radially inwardly and axially upwardly, being coupled to the lower end of base 64 by the concave resilient wall portion 74. The inner end of wall portion 72 terminates in a slit opening 76 that extends diametrically of valve 36. The pair of circumferentially and radially extending lugs 78 are formed on the underside of wall portion 72. A pair of diametrically extending opposed ribs 80 are disposed on either side of slit opening 76. Valve 36 may be unitarily formed of suitable elastic plastic composition such as thermoplastic elastomer, preferably in an injection molding or other suitable operation.

Figure 12:
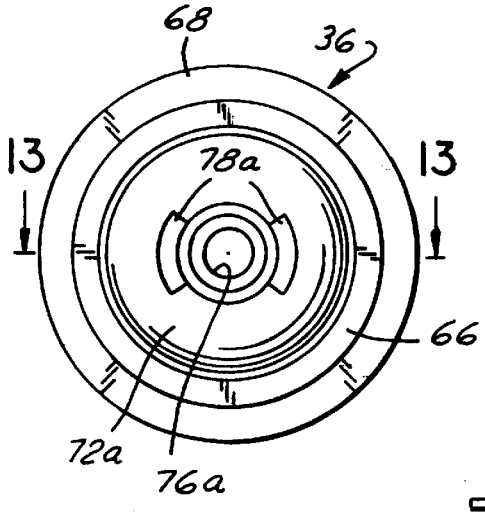
FIG. 12 is a bottom plan view of the valve illustrated in FIGS. 10 and 11 as fabricated.
Figure 13:
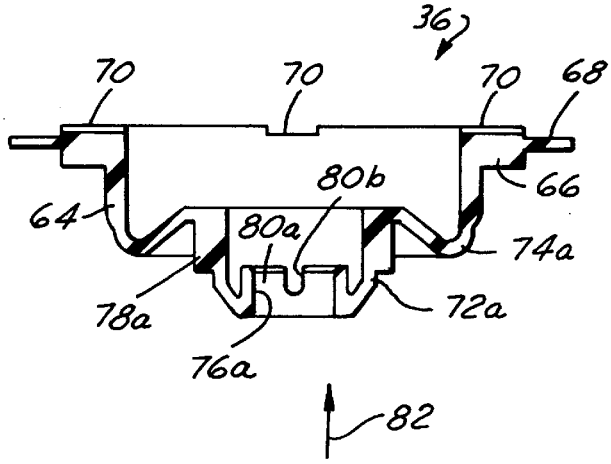
FIG. 13 is a sectional view taken substantially along the line 13—13 in FIG. 12.

FIGS. 12–13 illustrate valve 36 as initially formed. Elements in FIGS. 12–13 that are identical as formed and as used are indicated by correspondingly identical reference numerals, and elements that are re-oriented between formation and use are indicated in FIGS. 12–13 by corresponding reference numerals followed by the suffix "a." In the valve 36 as formed, wall portion 72*a* is initially cylindrical, and the integral ribs 78*a* extend axially along the outer surface of wall portion 72*a*. The inner edge of wall portion 72*a* terminates in a cylindrical mouth 76*a* that is surrounded a circumferential rib 80*a* that has diametrically opposed interruptions 80*b*. The as-formed configuration of valve 36 illustrated in FIGS. 12 and 13 preferably has no internal residual stresses, and is substantially stress-free in the configuration as shown. Following fabrication and cooling, the interior portion of valve 36, including wall portion 72*a* and ribs 80*a* forming cylindrical opening 76*a*, is inverted by being urged upwardly in the direction 82 in FIG. 13, so that wall portion 72*a* and opening 76*a* invert to the configuration illustrated in FIGS. 10 and 11. In this configuration, opening 76*a* assumes the configuration of a diametric slit 76. Internal stresses within wall portion 72 and lugs 78 hold slit 76 closed, while ribs 80 maintain the diametric orientation of the slit. These internal stresses tend to re-invert the valve; but such re-inversion is prevented by abutment at slit 76, and by basket 34 in assembly as will be described.

Figure 2:
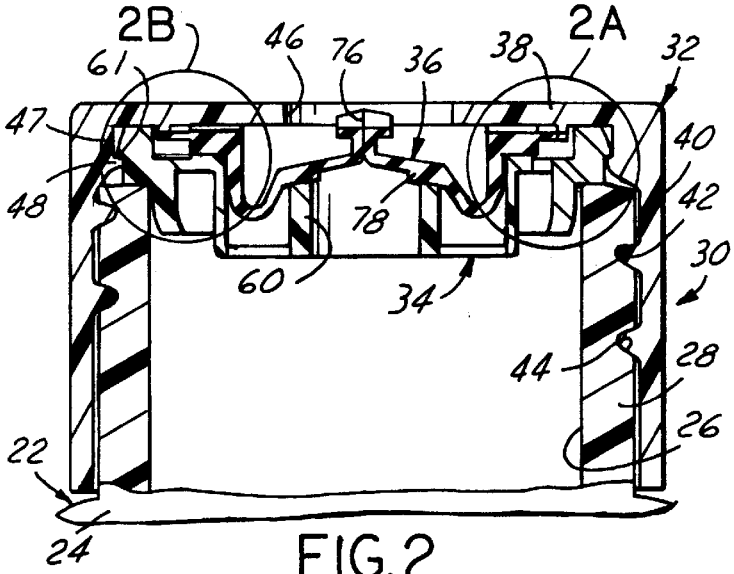
FIG. 2 is a fragmentary sectional view on an enlarged scale of the container finish and closure in the embodiment of FIG. 1.
Figure 2A:
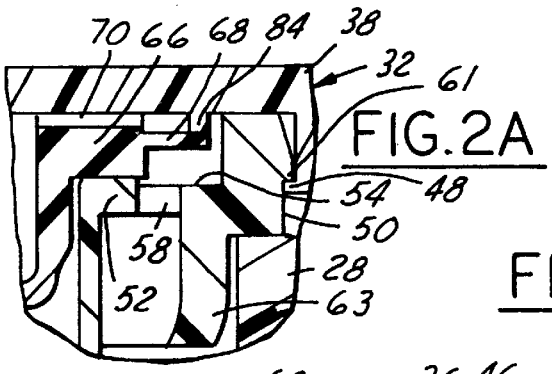
FIGS. 2A and 2B are fragmentary sectional views on an enlarged scale of the portions of FIG. 2 within the respective circles 2A and 2B.
Figure 2B:
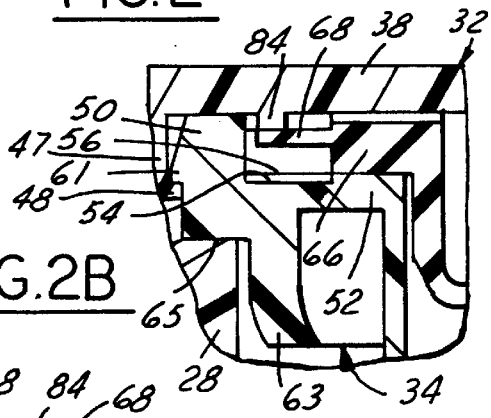
Figure 3:
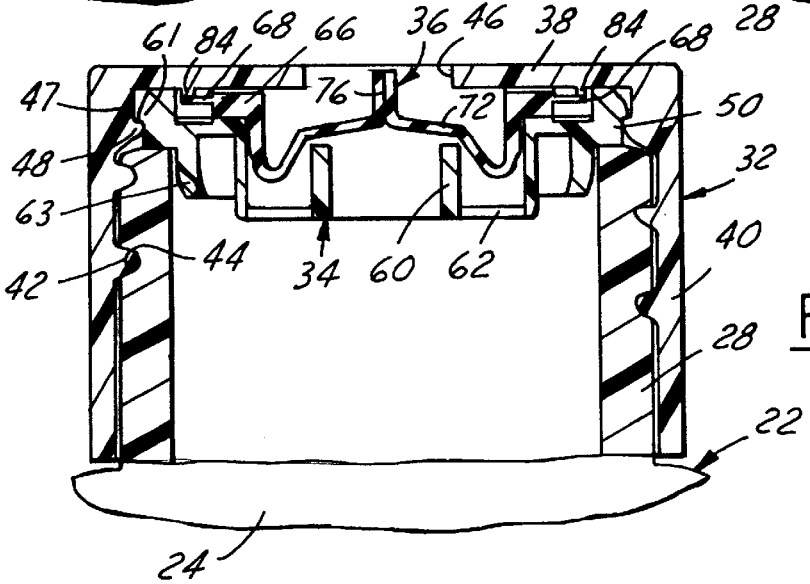
FIG. 3 is a sectional view similar to that of FIG. 2 but taken from a direction 90 degrees offset from that in FIG. 2.
Figure 4:
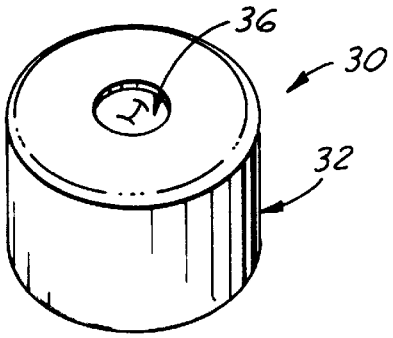
FIG. 4 is a perspective view of the closure assembly in the container package of FIG. 1.
Figure 6:
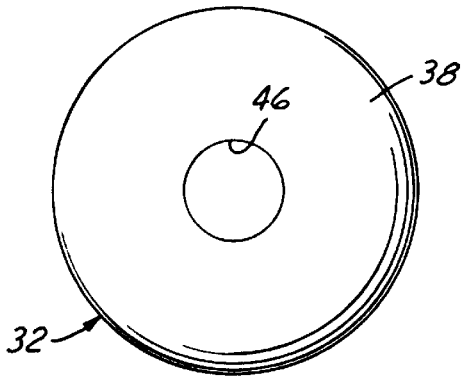
FIGS. 6 and 7 are top plan view and a side elevational view of the closure illustrated in FIGS. 4 and 5.
Figure 5:
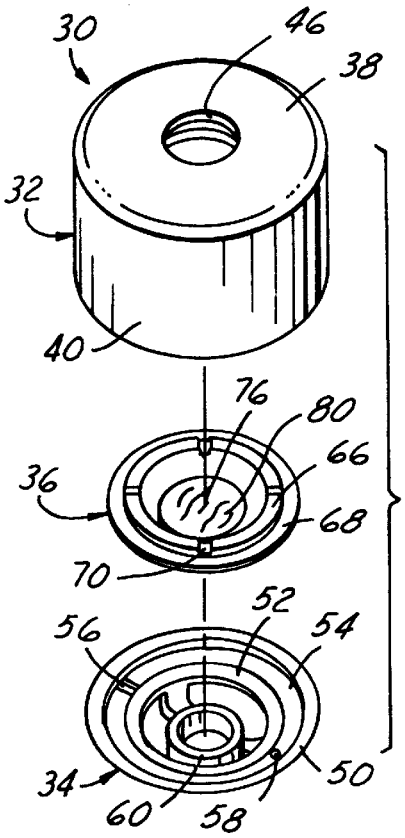
FIG. 5 is an exploded perspective view of the closure assembly illustrated in FIG. 4.
Figure 7:
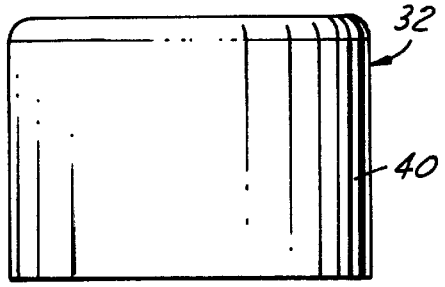

Referring now to FIGS. 2–3, valve 36 is captured in assembly between 20 basket 34 and base wall 38 of closure 32. Specifically, valve 36 is placed on basket 34, and basket 34 is inserted into closure 30. When the sloping outer surface of wall 50 abuts lip 48 on shoulder 47, the shoulder is cammed radially outwardly until shoulder 61 snaps beneath lip 48. The spacing between lip 48 and base wall 38 is such as to hold basket 34 firmly in assembly. At this point, rib 66 on valve 36 is sandwiched in assembly between base 52 of basket 34 and the opposing internal surface of closure base wall 38. Lip 68 on valve 36 normally resiliently engages an annular internal rib 84 on closure base wall 38, and basket through-opening 58 (FIG. 2A) and basket rib 56 (FIG. 2B) underlie valve lip 68. Slots 70 on valve rib 66 cooperate with the opposing inner surface of valve base wall 38 to form radial passages for venting the interior of container 20, as will be described. Skirt 63 on basket 34 is disposed in assembly adjacent to the interior of container finish 28, with the axial shoulder 65 on wall 50 sealing against the upper edge of the container finish. The upper edge of basket collar 60 engages lugs 78 on valve 36 to support slit opening 76 within opening 46 of closure 32, and to prevent re-inversion of the valve under negative pressure when container 22 is released.

Closure assembly 30 is prefabricated, as is container 22. After container 22 is filled with product, closure assembly 30 is affixed to finish 28 of container 22. The packager who fills and caps the container is usually different from the party or parties who fabricate the container and the closure assembly. In this connection, closure assembly 30, including closure 32, basket 34 and valve 36, may be fabricated as a subassembly and shipped to the packager without the valve or basket falling out of the closure. This saves shipping costs and handling costs at the packager. When it is desired to dispense product, body 24 of container 22 is manually squeezed, so that the viscous product within the container applies pressure to the underside of valve 36 through basket collar 60 and the spaces between spokes 62. This pressure moves wall portion 72 of valve 36 upwardly in the orientation of FIGS. 2–3, and opens slit 76 against the resilient forces applied thereto by ribs 80, lugs 78 and wall portion 72. The pressure within container 22 also urges lip 68 of valve 36 against rib 84 on closure base 38, so that a product is dispensed from within the container.

When the container is released following dispensation of product, negative pressure within the container and the force of withdrawing product, coupled with the internal biasing forces of valve 36, return valve 36 to the closed positioned illustrated in the drawings. In the meantime, the negative pressure within container 22 urges valve lip 68 downwardly away from closure rib 84 to provide for venting of the container interior through slots 70 and through-opening 58. Rib 56 within channel 54 of basket 34 prevents lip 68 from sealing against the opposing surface of basket 34, which might otherwise block this venting operation.

I claim:

1. A valve for a self-sealing dispensing closure, said valve comprising a one-piece construction of integrally molded elastic composition that has an annular base, an internal wall portion that extends radially inwardly and axially from said annular base, a mouth portion that includes a slit opening oriented diametrically of said annular base, lugs on said wall portion that extend radially and axially along said wall portion, said lugs being internally stressed for resiliently biasing said slit closed, and ribs on said mouth portion that extend along each side of said slit, said ribs being internally stressed for maintaining diametric orientation of said slit.

2. A valve element for a self-sealing dispensing closure that comprises a one-piece construction of integrally molded elastic composition having an annular base, a web portion that extends radially inwardly from said base, a mouth portion that extends axially from an inner periphery of said web portion to a circular opening coaxial with said annular base, and a cylindrical lip that extends axially inwardly from said opening and having diametrically opposed gaps, such that axial inversion of said web and mouth portions positions said lip radially outwardly of said opening with said gaps permitting said lip to form diametrically opposed external ribs that configure said opening as a diametric slit, and such that internal residual stresses in said web portion bias said slit closed.

3. A self-sealing closure assembly that comprises:

a plastic closure shell having a central opening, and a self-sealing valve secured within said shell, said valve comprising a one-piece construction of integrally molded elastic composition that has an annular base, an internal wall portion that extends axially inwardly and axially from annular said base, a mouth portion that includes a slit opening oriented diametrically of said annular base, and lugs on said wall portion that extend radially and axially along said wall portion, said lugs being internally stressed for resiliently biasing said slit closed.

4. A squeeze container that comprises:

a resilient container body having an open mouth and a self-sealing closure affixed to said mouth, said closure comprising a closure shell with a central opening and a valve of one-piece construction of integrally molded elastic composition that has an annular base, an internal wall portion that extends radially inwardly and axially from said annular base, a mouth portion that includes a slit opening oriented diametrically of said annular base and aligned with said opening in said shell, and lugs on said wall portion that extend radially and axially along said wall portion, said lugs being internally stressed for resiliently biasing said slit closed.

5. A self-sealing closure assembly that comprises:

a plastic closure shell having a central opening, and a self-sealing valve secured within said shell, said valve comprising a one-piece construction of integrally molded elastic composition that has an annular base, an internal wall portion that extends axially inwardly and axially from said annular base, a mouth portion that includes a slit opening oriented diametrically of said annular base, said wall portion being internally stressed for resiliently biasing said slit closed, and ribs on said mouth portion that extend along each side of said slit, said ribs being internally stressed for maintaining diametric orientation of said slit.

6. A squeeze container that comprises:

a resilient container body having an open mouth and a self-sealing closure affixed to said mouth, said closure comprising a closure shell with a central opening and a valve of one-piece construction of integrally molded elastic composition that has an annular base, an internal wall portion that extends radially inwardly and axially from said annular base, a mouth portion that includes a slit opening oriented diametrically of said annular base and aligned with said opening in said shell, said wall portion being internally stressed for resiliently biasing said slit closed, and ribs on said mouth portion that extend along each side of said slit, said ribs being internally stressed for maintaining diametric orientation of said slit.

7. A valve for a self-sealing dispensing closure, said valve comprising a one-piece construction of integrally molded elastic composition that has an annular base, an internal wall portion that extends radially inwardly and axially from said annular base, a mouth portion that includes a slit opening oriented diametrically of said annular base, ribs on said mouth portion that extend along each side of said slit, said ribs being internally stressed for maintaining diametric orientation of said slit, a peripheral rib that extends radially outwardly from said annular base for attachment to a closure shell, and a peripheral lip that extends axially outwardly from said peripheral rib, said peripheral rib and said lip being circumferentially continuous, and said lip being thinner and more flexible than said peripheral rib.

8. The valve set forth in claim 7 wherein said one-piece construction further includes lugs on said wall portion that extend radially and axially along said wall portion, said lugs being internally stressed for resiliently biasing said slit closed.

9. The valve set forth in claim 8 wherein said lugs are disposed on a side of said wall portion remote from said annular base.

10. The valve set forth in claim 9 wherein said lugs are diametrically opposed to each other and orthogonal to said slit.

11. The valve set forth in claim 1 wherein said one-piece construction further includes a peripheral rib that extends radially outwardly from said annular base for attachment to a closure shell.

12. The valve element set forth in claim 11 wherein said one-piece construction further includes a peripheral lip that extends radially outwardly from said peripheral rib, said rib and said lip being circumferentially continuous, and said lip being thinner and more flexible than said rib.

13. The valve element set forth in claim 8 or 12 wherein said peripheral rib has at least one radial slot in a surface thereof remote from said lugs.

14. The valve element set forth in claim 13 comprising a circumferential array of said radial slots angularly spaced from each other.

15. The valve element set forth in claim 2 wherein said one-piece construction further includes a pair of diametrically opposed lugs on said web portion at 90 degree spacing from said gaps in said lip, such that internal residual stresses in said lugs following axial inversion of said web and mouth portions bias said slit closed.

16. The valve element set forth in claim 15 wherein said one-piece construction further comprises a peripheral rib that extends radially outwardly from said annular base for attachment of said construction to a closure shell following inversion of said construction.

17. The valve element set forth in claim 16 wherein said one-piece construction further includes a peripheral lip that extends radially outwardly from said peripheral rib, said rib and said lip being circumferentially continuous, and said lip being thinner and more flexible than said rib.

18. The valve element set forth in claim 17 wherein said peripheral rib has at least one radial slot in a surface thereof remote from said lugs.

19. The valve element set forth in claim 18 comprising a circumferential array of said radial slots angularly spaced from each other.

20. The closure assembly set forth in claim 5 wherein said one-piece construction further includes lugs on said wall portion that extend radially axially along said wall portion, said lugs being internally stressed for resiliently biasing said slit closed.

21. The closure assembly set forth in claim 3 wherein said lugs are disposed on a side of said wall portion remote from said annular base.

22. The closure assembly set forth in claim 21 wherein said lugs are diametrically opposed to each other and orthogonal to said slit.

23. The closure assembly set forth in claim 22 further comprising means for securing said valve within said closure shell while supporting said lugs against axial movement away from said opening.

24. The closure assembly set forth in claim 23 wherein said securing means comprises an annular wall having means for engaging said closure shell for securing said valve and said securing means within said shell.

25. The closure assembly set forth in claim 24 wherein said annular wall has an annular shoulder that is received by snap fit within an annular lip on said closure shell.

26. The closure assembly set forth in claim 25 wherein said shoulder on said annular wall has a conical surface for camming said lip outwardly to receive said shoulder by snap fit.

27. The closure assembly set forth in claim 3 wherein said one-piece construction further includes ribs on said mouth portion that extend along each side of said slit, said ribs being internally stressed for maintaining diametric orientation of said slit.

28. The closure assembly set forth in claim 3 or 5 wherein said valve has a peripheral rib that extends radially outwardly from said base, said assembly further comprising means secured to said shell and capturing said valve at said shell opening.

29. The closure assembly set forth in claim 28 wherein said closure shell has an internal rib surrounding said opening and wherein said one-piece construction further includes a peripheral lip that extends radially outwardly from said peripheral rib in engagement with said internal rib.

30. The closure assembly set forth in claim 29 wherein said peripheral rib has at least one radial slot in a surface thereof remote from said lugs.

31. The closure assembly set forth in claim 30 comprising a circumferential array of said radial slots angularly spaced from each other.

32. The closure assembly set forth in claim 31 wherein said means has a through-opening that underlies said lip on said valve.

33. The closure assembly set forth in claim 32 in combination with a resilient container body having an open mouth to which said self-sealing closure assembly is secured, said valve opening under pressure when said body is squeezed, and said slot, said lip and said through-opening venting said body when said body is released.

34. The container set forth in claim 4 wherein said lugs are disposed on a side of said wall portion remote from said annular base.

35. The container set forth in claim 34 wherein said lugs are diametrically opposed to each other and orthogonal to said slit.

36. The container set forth in claim 35 further comprising means for securing said valve within said closure shell while supporting said lugs against axial movement away from said opening.

37. The container set forth in claim 36 wherein said securing means comprises an annular wall having means for engaging said closure shell for securing said valve and said securing means within said shell.

38. The container set forth in claim 37 wherein said annular wall has an annular shoulder that is received by snap fit within an annular lip on said closure shell.

39. The container assembly set forth in claim 38 wherein said shoulder on said annular wall has a conical surface for camming said lip outwardly to receive said shoulder by snap fit.

40. The container set forth in claim 4 wherein said one-piece construction further includes ribs on said mouth portion that extends along each side of said slit, said ribs being internally stressed for maintaining diametric orientation of said slit.

41. The container set forth in claim 4 or 6 wherein said valve has a peripheral rib that extends radially outwardly from said base, said assembly further comprising means secured to said shell and capturing said valve at said shell opening.

42. The container set forth in claim 41 wherein said closure shell has an internal rib surrounding said opening, and wherein said one-piece construction further includes a peripheral lip that extends radially outwardly from said peripheral rib in engagement with said internal rib.

43. The container set forth in claim 42 wherein said peripheral rib has at least one radial slot in a surface thereof remote from said lugs.

44. The container set forth in claim 43 comprising a circumferential array of said radial slots angularly spaced from each other.

45. The container set forth in claim 44 wherein said means has a through-opening that underlies said lip on said valve, said valve opening when said body is squeezed, and said slot, said lip and said through-opening venting said body when said body is released.

46. The container set forth in claim 6 wherein said one-piece construction further includes lugs on said wall portion that extend radially axially along said wall portion, said lugs being internally stressed for resiliently biasing said slit closed.

* * * * *